United States Patent [19]

Bozzio

[11] Patent Number: 4,700,602

[45] Date of Patent: Oct. 20, 1987

[54] ELECTRONIC DRUM

[76] Inventor: Terry Bozzio, 449 S. Beverly. Ste. 102, Beverly Hills, Calif.

[21] Appl. No.: 750,305

[22] Filed: Jul. 1, 1985

[51] Int. Cl.[4] ..... G10H 3/14

[52] U.S. Cl. ..... 84/1.14; 84/DIG. 12; 84/DIG. 24

[58] Field of Search ..... 84/1.04, 1.06, 1.14, 84/DIG. 12, DIG. 24

[56] References Cited

U.S. PATENT DOCUMENTS

| | | | |
|---|---|---|---|
| 3,551,580 | 12/1970 | Glenn et al. | 84/DIG. 12 |
| 3,553,339 | 1/1971 | Dominguez et al. | 84/DIG. 12 |
| 3,659,032 | 4/1972 | May | 84/DIG. 12 |
| 4,479,412 | 10/1984 | Klynas | 84/1.04 |

OTHER PUBLICATIONS

Dynacord Duopad, D-8440, Straubing, (W. Germany), Postfach 0254, Telefon (09421), 3101, Telex 65520, published on or before Apr. 19, 1985.

*Primary Examiner*—Stanley J. Witkowski

*Attorney, Agent, or Firm*—Spensley Horn Jubas & Lubitz

[57] ABSTRACT

An electronic drum having multiple sound sources with rapidly detachable striking elements and transducers. The drum may contain one or more striking elements each producing a separate electrical output signal. A separate piezoelectric transducer is attached to each striking element. The drum includes a base structure to which various acoustically dampening compressible elements are attached. The striking elements are removably attached to the compressible elements and are acoustically isolated from one another so that vibrations caused by hitting one striking element are not picked up by the transducers attached to the other striking elements. Transducers are attached to the striking elements by first bonding resilient elements to the striking elements and then bonding the transducers to the resilient elements. The electronic drum permits a drummer to employ conventional acoustical "sticking" techniques and may be used to simulate various other percussion type instruments.

7 Claims, 4 Drawing Figures

ELECTRONIC DRUM

BACKGROUND OF THE INVENTION

1. Field of the Invention:

The present invention concerns electronic musical instruments and more particularly an electronic drum.

2. Description of the Prior Art:

Electronic musical instruments are becoming increasingly popular with modern musical groups. Such instruments typically translate a vibration in an element manipulated by a performer into an electrical output signal which can then be processed by diverse methods. Electronic instruments generally offer a rich variety of musical sounds through electronic processing with substantial versatility in individual instruments.

Electronic drums are one form of electronic musical instruments in which a performer typically hits a striking element with a drumstick to produce a vibration in the striking element which is subsequently translated into an electrical output signal. Through electronic processing, some electronic drums can be used to simulate virtually any type of percussion instrument.

A number of electronic drums have been developed in the past. Typically these instruments include a conventional drum structure with varying types of transducer elements disposed within the drum to sense vibrations in a conventional drum diaphragm. One illustrative example is disclosed in U.S. Pat. No. 4,226,156 in which a vibration responsive element is embedded in a mute assembly. The mute assembly and vibration responsive element are brought into contact with a conventional drum diaphragm to both dampen normal acoustical tones generated by the diaphgram and to produce electrical tones.

Previous electronic drums have also employed one or more ferromagnetic elements attached to the underside of a generally conventional drum diaphragm with one or more sensing coils or reluctance elements disposed within the drum in proximity to the ferromagnetic elements. Various examples of this structure are provided in U.S. Pat. Nos. 4,242,937, 3,956,959, and 3,553,339. In yet another electronic drum disclosed in U.S. Pat. No. 4,279,188, the sensing element includes a foam conducting element, contiguous with a drum diaphragm having a resistance varying in response to compressive forces.

None of these examples allow for ready removal of a striking element or transducive element in the event of cracking in the former or failure in the latter. This can be a particular problem during live performances. These exemplary electronic drums are also generally the same size as conventional drums. Thus a drummer employing generally the same number of electronic drums is generally obscured from view during performances. While some of these exemplary electronic drums incorporate more than one striking surface or transducive element, none allow the use of a drummer's conventional acoustical "sticking" techniques. These playing techniques include, for example, such practices as "rim shots" (hitting the drum head and rim simultaneously) "side sticking" (laying the tip of a drumstick on the drum head and tapping the drum rim) and "stick on rim" (striking the drum rim alone).

Thus the manner in which the instrument can be played is somewhat limited. Consequently there exists a need for a small electronic drum in which a striking element or transducive element can be readily replaced in the event of failure and which permits the use of a drum performer's conventional acoustical "sticking" techniques.

SUMMARY OF THE INVENTION

It is therefore a goal of the present invention to provide an electronic drum having easily replaceable striking elements and transducers. It is a further goal of the present invention to provide an electronic drum with several acoustically isolated striking elements. Still another goal of the present invention is to provide an electronic drum structure of reduced size permitting better exposure of a performer during live performances. Yet another goal is to provide a slightly resilient striking element which is shock mounted to reduce strain on a performer's hands and wrists from hitting the striking element with conventional drumsticks. A further goal is to provide an electronic drum structure on which performers can employ conventional acoustical "sticking" playing techniques such as the rim shot, side stick, and stick on rim techniques.

These and other goals and objectives are accomplished in the present inventive electronic drum, in its prsently preferred embodiment, by attaching piezoelectric material transducers directly to separate striking elements. A rigid base structure is provided with a plurality of resiliently compressible foam elements bonded to the base. The striking elements are removably attached to foam elements which acoustically isolate the striking elements and further lessen the impact forces experienced by a performer when hitting the striking elements with drumsticks. The striking elements are slightly resilient and separately configured as a central plate and one or more side rails located at the rim or edges of the central plate so as to permit use by a performer of conventional acoustical sticking strokes on the rails. By attaching the transducers directly to the striking elements, the entire electronic drum may be configured substantially smaller than conventional drums and previous electronic drum structures.

The novel features which are believed to be characteristic of the present invention, together with further objectives and advantages thereof, will be better understood from the following detailed description considered in connection with the accompanying drawings. It should be expressly understood, however, that the drawings are for purposes of illustration and description only and are not intended as a definition of the limits of the invention.

BRIEF DESCRIPTION OF THE DRAWINGS

Like reference numbers in the drawings refer to like elements.

DETAILED DESCRIPTION

Figure 1:
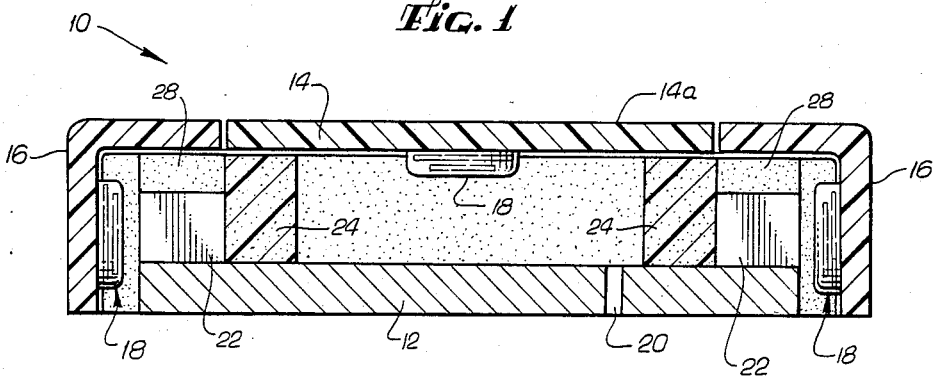
FIG. 1 is a sectional side view of a preferred embodiment of the present inventive electronic drum.

Referring to the figures, and more particularly to FIG. 1, there is shown a preferred embodiment of the present inventive electronic drum 10. The electronic drum 10 includes a rigid base structure 12 and several detachable striking elements including a central plate 14 and side rails 16. Separate piezoelectric transducer assemblies 18 are individually bonded to the central plate 14 and side rails 16. A pair of wires extend from each transducer assembly 18 and are joined to wires partially disposed within the electronic drum 10 and extending out of the drum 10 to appropriate electronic processing equipment. Any quick-disconnect type of electrical connectors (such as, for example, MOLEX type connectors) can be used to join the piezoelectric transducer wires to wires leading to the electronic processing equipment. A bore 20 is provided in the base 12 as a passage out of the drum structure for the wires leading to the processing equipment.

Piezoelectric transducers are well known in the prior art and are available from a number of sources such as, for example, Kyocera International Inc. of San Diego, Calif.

The central plate 14 and side rails 16 are removably attached to a plurality of foam elements bonded to the base 12. The foam elements acoustically isolate the central plate 14 and side rails 16 from one another and also lessen the shock caused by hitting the central plate 14 or side rails 16 either with the performer's hands or with conventional drumsticks. When mounted on the base 12, there is a slight gap between the central plate 14 and the side rails 16. If desired this gap can be filled with an additional strip of foam to further acoustically isolate the side rails 16 and central plate 14.

Both the central plate 14 and side rails 16 are composed of a slightly resilient material. This material may be any thermoplastic polymeric compound, preferrably nylon or LEXAN. As is well known in the art, nylon is a generic term for a long-chain synthetic polymeric amide and LEXAN is a trademarked thermoplastic polycarbonate condensation product of bisphenol-A and phosgene.

It should be possible to provide a lamination of rubber-like material or soft plastic on the upper striking portion of a LEXAN or nylon striking element to create a softer playing surface and increase the degree of rebounding experienced when a drumstick hits the striking surface. The lamination would also lessen the acoustical noise produced by the drumstick hitting the striking element.

Figure 2:
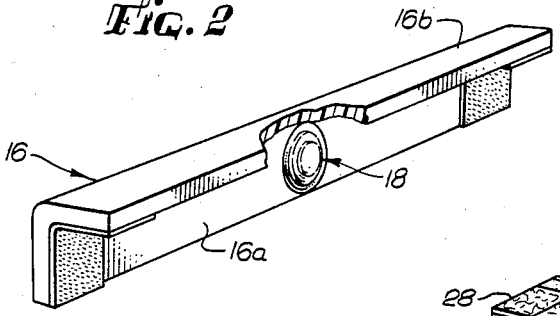
FIG. 2 is a perspective view of a side rail of the present inventive drum.

In the preferred embodiment the drum 10 has a generally rectangular appearance with the central plate 14 and side rails 16 forming a generally square playing area. The central plate 14 has a generally rectangular striking area with a piezoelectric transducer assembly 18 attached on a surface opposite the striking surface 14*a*. As shown in FIG. 2, each side rail 16 is a unitary structure having a generally elongated approximately right angle configuration with a first portion 16*a* and a second portion 16*b* merging in a continuous curve. The piezoelectric transducer assemblies 18 can be mounted on the interior of either portion 16*a* or 16*b*. In the preferred embodiment, the piezoelectric transducer assemblies 18 are mounted onto the vertical side rail portions 16*a*. It has been found that the avoidance of sharp angles between the merger of portions 16*a* and 16*b* avoids creation of an acoustical dead zone at the edge of the merger. Vibrations in the side rails 16 caused by striking a dead zone are not picked up well by the piezoelectric transducers 18*a*.

Figure 3:
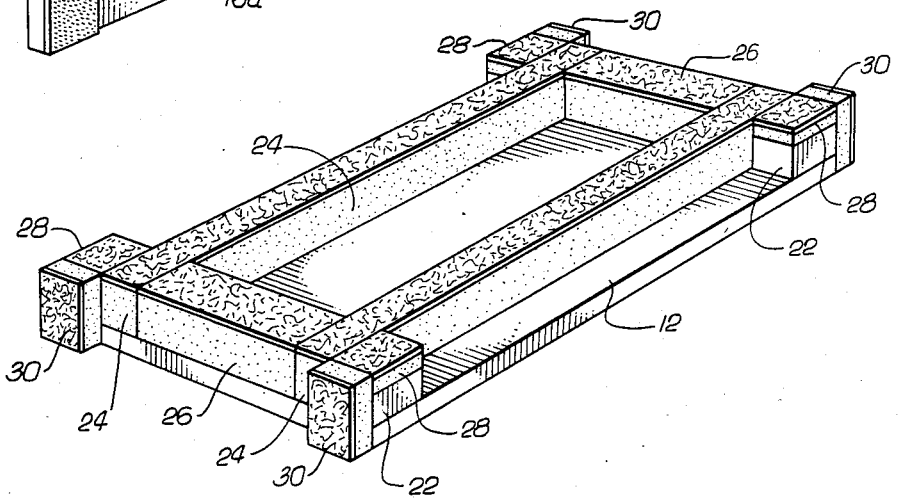
FIG. 3 is a perspective view of the base structure of the present inventive drum.

The base 12 and foam elements supporting the central plate 14 and side rails 16 are shown in FIG. 3. End blocks 22 made of a rigid material are attached to the base 12 at each of its corners. Two pairs of inner foam elements 24, 26 are attached to the base 12 to support and shock mount the central plate 14. The end foam elements 24 extend entirely across the base 12 between sides of the base 12 adjacent those to which the side rails 16 are mounted. The side foam elements 26 extend along these base sides between the end foam elements 24. In the preferred embodiment, VELCRO (a trademark for fibrous detachable fasteners) is attached to the upper surfaces of the foam element pairs 24, 26 to removably attach the central plate 14 to the base 12. A corresponding VELCRO material is attached to the central plate 14 on the same side as the piezoelectric transducer assembly 18. Other types of quickly detachable fasteners such as reattachable adhesives could be used in place of the VELCRO. The foam element pairs 24, 26 are attached to the base plate 12 with any suitable adhesive sufficiently strong to resist the separation force of the VELCRO. Side plates (not shown) are bonded to the base 12 extending entirely across the base 12 adjacent the side foam elements 26 to cover up the internal structure of the drum 10 not obscured by the side rails 16.

Four pairs of additional foam elements 28, 30 are respectively attached to the end blocks 22 along the upper surface and exterior side of the blocks 22 to which the side rails 16 are attached. The foam elements 30 may extend along the entire height of the end blocks 22 and the width of the base 12. The side rails 16 are similarly removably attached to the foam element pairs 28, 30 by corresponding VELCRO portions respectively attached to the adjacent surfaces of the foam element pairs 28, 30 and the inner ends of the side rails 16. To provide additional acoustical dampening, a thin strip of foam may be sandwiched between the inner surface of the side rails 16 and the complementary VELCRO attached to the side rails.

Figure 4:
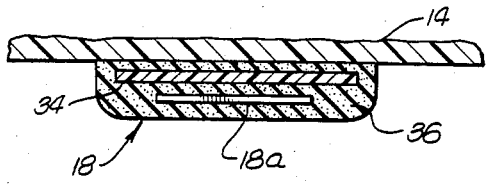
FIG. 4 is a side view detailing attachment of a transducer to a striking element.

FIG. 4 shows the manner in which individual piezoelectric transducers 18*a* are acoustically coupled to the central plate 14 and the side rails 16. Slightly resilient elements 34 are first bonded to the central plate 14 and side rails 16 with a room temperature vulcanizing type of adhesive having a rubbery character when cured. Such adhesives are well known in the art. The piezoelectric transducers 18a are then bonded to the resilient elements 34 with the same adhesive. Finally the entire piezoelectric transducer assembly 18 is encapsulated in a coating 36 of this adhesive. The resilient elements 34 may be composed of the same material as the central plate 14 and the side rails 16, preferrably LEXAN. It has been found that bonding the piezoelectric transducer 18*a* the central plate 14 and side rails 16 via resilient elements 34 is necessary to partially shield the piezoelectric transducer 18*a* from shock and striking element flexure encountered when the central plate 14 and side rails 16 are struck during playing. Using a rubbery adhesive provides further shock attenuation. The piezoelectric transducer assemblies 18 are encapsulated in a coating of the adhesive to protect the piezoelectric transducer wires from dislodging due to playing shocks.

In operation, a performer can utilize conventional drum techniques, deriving a first musical tone from striking the central plate 14 and first and second alternative tones by respectively striking the side rails 16. Due to the location of the side rails 16 adjacent the central plate 14, conventional acoustical "sticking" techniques can be employed when striking the side rails 16.

The electronic drum 10 can also be used as an entirely different type of percussion instrument than a drum.

For example, the electric drum 10 can also be used to simulate a cymbal. Typically there are three basic cymbal techniques associated with hitting the bell of a cymbal (prducing a conventional cymbal bell note), hitting the cymbal surface with the tip of a drumstick (producing a "ping" or "ride" sound) and hitting the side of the cymbal with the side of the drumstick (producing a "crash" type of sound). With electronic processing, these same notes can be produced with the electronic drum 10 by assigning each type of tonal sound to a different striking element. For example, the bell sound could be produced by striking a side rail 16 furthest from the drummer, the "ping" or "ride" sound provided by striking the central plate 14, and the "crash" sound produced by striking a side rail 16 nearest the drummer.

The use of a removable attachment between the central plate 14, side rails 16 and base 12 permit convenient replacement of worn elements. If a piezoelectric transducer 18 should fail or one of the striking elements fracture, the failed structure can be readily removed from the VELCRO bonding to the base 12 and the piezoelectric transducer wires unplugged from the electrical connectors. A new piezoelectric transducer and striking element structure can then be quickly mounted onto the drum 10.

Since the piezoelectric transducers 18 are directly attached to the striking elements, the entire drum 10 stucture can be fairly small. One such drum has been constructed with the combined striking areas of the central plate 14 and side rails 16 comprising less than one square foot. A plurality of such drums 10 can be mounted together to form a relatively compact drum set allowing substantial visibility of a drummer. One set has been constructed with 32 separate striking elements contained in approximately a three foot arc.

It will, of course, be understood that modifications of the present inventive electronic drum and its various aspects will be apparent to those skilled in the art, some being apparent only after study and others being merely matters of routine mechanical design. For example, the base 12 could have a polygonal shape with more than four sides to provide additional edges on which further side rails 16 could be mounted. Similarly, a drum 10 could be constructed without any side rails 16. Thus, the scope of the present invention should not be limited by the particular embodiments herein described, but should be defined only by the appended claims and equivalents thereof.

What is claimed is:

1. An electronic drum comprising:

a rigid base;

first and second striking elements mounted on said base, said striking elements producing vibrations when impacted;

first and second transducer means acoustically coupled respectively to said first and second striking elements for converting said vibrations in said first and second striking elements into electrical signals;

resiliently compressible foam element means interposed between said base and said striking elements for reducing impact shock experienced by a performer when striking said striking elements and also for acoustically isolating said striking elements from one another; and detachable fastener means interposed between said base and said striking elements for detachably fastening said striking elements to said base thereby permitting quick removal of said striking elements from said base when said striking elements need to be replaced.

2. The electronic drum of claim 1 further comprising a resilient element interposed between at least one of said striking elements and its respective transducer means for partially shielding its respective transducer means from excessive shock.

3. The electronic drum of claim 2 further comprising a rubbery adhesive layer interposed between said respective transducer means and said resilient element for bonding said respective transducer means to said resilient element and for providing additional shock protection to said respective transducer.

4. The electronic drum of claim 1 wherein said first striking element is a plate and said second striking element is a unitary structure having a first flat portion coplanar with said first striking element and joined to a second portion of said unitary structure at approximately a right angle in a continuous curve.

5. The electronic drum of claim 4 wherein said second portion of said unitary structure is located near an edge of said rigid base to thereby form a drum rim.

6. The electronic drum of claim 1 wherein said rigid base is formed generally as an arc.

7. The electronic drum of claim 1 wherein said first and second transducer means are respectively bonded to said first and second striking elements by a rubbery adhesive such that said first and second transducer means are quickly removable with said first and second striking elements when replacement of either of said first and second transducer means is desired.

* * * * *